US012760541B2

(12) United States Patent
Butcher

(10) Patent No.: US 12,760,541 B2
(45) Date of Patent: Oct. 13, 2026

(54) MODULAR THEATRE FLATS DEVICE

(71) Applicant: Austin Butcher, Springfield, MO (US)

(72) Inventor: Austin Butcher, Springfield, MO (US)

( * ) Notice: Subject to any disclaimer, the term of this patent is extended or adjusted under 35 U.S.C. 154(b) by 119 days.

(21) Appl. No.: 18/905,601

(22) Filed: Oct. 3, 2024

(65) Prior Publication Data

US 2025/0243681 A1 Jul. 31, 2025

Related U.S. Application Data

(60) Provisional application No. 63/626,689, filed on Jan. 30, 2024.

(51) Int. Cl.
*E04H 3/24* (2006.01)

(52) U.S. Cl.
CPC ..... *E04H 3/24* (2013.01)

(58) Field of Classification Search
CPC ..... E04H 3/24; H05K 5/02; H05K 5/0021
See application file for complete search history.

(56) References Cited

U.S. PATENT DOCUMENTS 3,908,787 A 9/1975 Wenger et al.
3,984,949 A * 10/1976 Wahlquist ..... E04B 2/74 52/143
4,026,076 A 5/1977 Analetto
4,200,254 A * 4/1980 Nelson ..... E04B 2/7405 248/188.8
4,958,671 A * 9/1990 Bove ..... E04B 2/7429 160/351
5,313,754 A * 5/1994 Jensen ..... E04F 19/02 52/287.1
5,524,691 A 6/1996 Jines
6,164,018 A 12/2000 Runge et al.
8,336,238 B1 * 12/2012 Hines ..... G09F 1/08 40/539
9,650,797 B2 5/2017 Stroud et al.
12,284,772 B2 * 4/2025 Artale ..... G09F 9/3026
2010/0051211 A1 * 3/2010 Chen ..... E04B 2/7427 160/135

(Continued)

FOREIGN PATENT DOCUMENTS

JP 2004162446 A * 6/2004
JP 2004204592 A * 7/2004

OTHER PUBLICATIONS

Dennis J. Sporre, The Art of Theatre (Prentice-Hall, 1993), p. 302 (Year: 1993) (Year: 1993).*

*Primary Examiner* — Babajide A Demuren
(74) *Attorney, Agent, or Firm* — Brennan, Manna & Diamond, LLC

(57) ABSTRACT

A modular theater flat device is disclosed that allows users to take theater flats apart and reconfigure them. The modular theater flat device comprises a base component that is configured in a rectangular shape that comprise wood panels with an aluminum frame, with magnetic strips and screws positioned on the sides. Multiple base components would then be secured together via the magnetic strips and screws. Each base component also comprises triangular bracing legs that secure the base component to the floor. Further, at the top and bottom of each base component on a back surface there are positioned magnets to attach trim pieces to the front surface. Additionally, the base components can have doors and/or windows cut into them, as needed.

5 Claims, 4 Drawing Sheets

(56) References Cited

U.S. PATENT DOCUMENTS

| | | | | |
|---|---|---|---|---|
| 2019/0107134 | A1* | 4/2019 | Di Quadri | F16B 12/28 |
| 2022/0341190 | A1* | 10/2022 | Cashman | E04F 19/0472 |
| 2024/0080995 | A1* | 3/2024 | Artale | G09F 9/3026 |

* cited by examiner

MODULAR THEATRE FLATS DEVICE

CROSS-REFERENCE TO RELATED APPLICATION

The present application claims priority to, and the benefit of, U.S. Provisional Application No. 63/626,689, which was filed on Jan. 30, 2024, and is incorporated herein by reference in its entirety.

FIELD OF THE INVENTION

The present invention relates generally to the field of modular theater flat devices. More specifically, the present invention relates to a modular theater flat device designed to be arranged in various configurations to create theater settings. Accordingly, the present disclosure makes specific reference thereto. Nonetheless, it is to be appreciated that aspects of the present invention are also equally applicable to other like applications, devices and methods of manufacture.

BACKGROUND

By way of background, this invention relates to improvements in modular theater flat devices. Generally, when creating theater sets, the set is built and thrown out when a new one is required. Further, reusing a set is typically not possible, ultimately wasting significant time and material. However, people who build theater sets may have limited time and space to do so in theater venues.

Additionally, sets can be dangerous to build, and people may suffer injury while using ladders, power tools, and other similar items. Thus, users may injure themselves re-building sets. Further, users may not have the time needed to re-build sets each time. Accordingly, there is a need for modular device that allows users to re-use theater sets.

Accordingly, there is a demand for an improved modular theater flat device that can designed to be arranged in various configurations to create reusable theater settings. More particularly, there is a demand for a modular theater flat device that allows users to quickly create unique sets for theater shows without having to constantly build and tear down current sets.

Therefore, there exists a long felt need in the art for a modular theater flat device that provides users with a device designed to be arranged in various configurations to create theater settings. There is also a long felt need in the art for a modular theater flat device that includes several aluminum and wood panels held together by magnetic strips and screws that can be arranged in a desired manner. Further, there is a long felt need in the art for a modular theater flat device that allows users to quickly create unique sets for theater shows without having to constantly build and tear down current sets. Moreover, there is a long felt need in the art for a device that saves considerable time and space when creating theater sets by offering a reusable device that can be tailored to specific needs and preferences. Further, there is a long felt need in the art for a modular theater flat device that comprises triangular bracing legs that help secure the device to the floor. Finally, there is a long felt need in the art for a modular theater flat device that contains magnets to hold on trim pieces.

The subject matter disclosed and claimed herein, in one embodiment thereof, comprises a modular theater flat device. The device is designed to allow the user to take theater flats apart and reconfigure them. The modular theater flat device comprises a base component that is configured in a rectangular shape that comprise wood panels with an aluminum frame, with magnetic strips and screws positioned on the sides. Multiple base components would then be secured together via the magnetic strips and screws. The frame can also have bolt holes to properly secure them together for use. The base component will come pre-assembled and ready for the user to configure them in the manner that they see fit. Each base component also comprises triangular bracing legs that secure the base component to the floor. Further, at the top and bottom of each base component on a back surface there are positioned magnets to attach trim pieces to the front surface. Additionally, the base components can have doors and/or windows cut into them, as needed.

In this manner, the modular theater flat device of the present invention accomplishes all of the forgoing objectives and provides users with a device that saves considerable time and space when creating theater sets. The device can be arranged in various configurations to create theater settings. The device can comprise artwork and other designs, secured with magnets.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a modular theater flat device. The device is designed to allow the user to take theater flats apart and reconfigure them. The modular theater flat device comprises a base component, with magnetic strips and screws positioned on the sides. Multiple base components would then be secured together via the magnetic strips and screws. The base components would come pre-assembled and ready for the user to configure them in the manner that they see fit. Each base component also comprises triangular bracing legs that secure the base component to the floor, during use.

Typically, a theater flat is a lightweight timber frame covered with scenic canvas, or plywood. Flats are used to provide a lightweight and easy to move and re-configure backdrop to a stage set. Flats sometimes have windows or doors built into them to provide extra flexibility, for use in realistic settings.

In one embodiment, the modular theater flat device comprises a base component that is configured in a rectangular shape but can be any suitable shape as is known in the art, depending on the needs and/or wants of a user, such as square, circular, etc. Typically, the base component can be any suitable size and shape as is known in the art, depending on the theater set that needs to be built for the respective theater show.

In one embodiment, the base component is comprised of a frame and center panel of varying sizes and shapes, that are manufactured of wood panels and aluminum, but can be manufactured of any suitable material as is known in the art. For example, the frame can comprise aluminum, carbon fiber, steel, wood, composite materials, etc., or any other suitable materials as is known in the art. Further, the center panel can then be manufactured of wood panels or composite materials, such as carbon fiber sheets, plastic particle board, wood particle board, etc., or any other suitable materials as is known in the art.

In one embodiment, the center panel of the base component comprises a front surface and a rear surface, with the top and bottom opposing edges and the right and left opposing edges being attached to the frame. Further, the frame comprises a front surface, a rear surface, a side which contacts the center panel and a side which faces away from the center panel. The frame would be secured to the center panel via any suitable securing means as is known in the art, such as glue, screws, bolts, etc., with the side that contacts the center panel. Further, the side of the frame which faces away from the center panel would comprise magnetic strips and screws. Accordingly, the vertical side of the frame would comprise a plurality of magnets which connect the base component with another base component. Thus, multiple base components can then be secured together side-by-side via the magnetic strips and screws.

In one embodiment, the frame can also comprise bolt holes to properly secure the base components together for use. In this embodiment, the magnets are there to help with the alignment between the base components. Once the magnets help align the base components in proper positioning, the bolt holes allow insertion of bolts to secure the base components together during use, to prevent the base components from being inadvertently pulled apart.

In one embodiment, the base component comprises a pair of triangular bracing legs that secure the base component to the floor. Typically, the back of each base component comprises hinges which secure to the triangular bracing legs. The hinges allow the legs to swing out to support the base components, during use. Thus, the legs can be extended out for use or retracted up toward the base component when needing to be stored. Once extended to prop up the base components, the legs can be bolted to the floor and/or weights can be positioned on them, so the base components don't move and are held securely in place via the legs. Any suitable number of legs can be utilized as is known in the art, typically there are two legs on each base component. In one embodiment, the base component also comprises a pair of long legs with attachment points on the back of the base component that help to stabilize the base component.

In one embodiment, the base component can also comprise a set of locking castors or wheels, which allow the base component to be easily moved on stage and transported to different rooms, theaters, etc. Any suitable number of castors can be utilized as is known in the art, typically there are two castors on each base component. Further, the castors would typically lock, so that once the base component is in position, the castors won't be able to be moved and the base component can be held in place. In one embodiment, the castors can be secured to hinges, which like the legs, can be extended out for use or retracted up toward the base component when needing to be stored. In one embodiment, castor wheels can be secured to the pair of triangular bracing legs, which can be put on through the bolt holes on the edges of the base component.

In one embodiment, the base components can be manufactured in different configurations, depending on the needs and/or wants of a user. For example, a base component can have a door cut out positioned on it. Further, the base component can have a window cut out positioned on it. Finally, the base component can have a door and/or a window cut out positioned on it. The windows and doors can be any suitable size, style, and shape as is known in the art. Further, these base components with door and/or window cut outs would also have magnets and bolt holes, such that the doors and windows are easy to align and can easily be put in or taken out and replaced by a new design or different type of door or window. In one embodiment, the base components comprise a removable face to make it easier to change the background scenery, typically using a keyhole design. In another embodiment, the base components can comprise corner components to change the angles that the base components are positioned in.

In one embodiment, the base component can comprise a plurality of magnets secured to the back side. The magnets are used to releasably secure trim pieces to the front side of the base components. Specifically, the trim is typically secured to the top and bottom of each base component and/or around the cut-out doors and windows. However, the trim can be magnetically secured to any suitable front surface of the base component, depending on the wants and/or needs of a user. Further, the magnets can also secure artwork, designs, patterns, photos, etc., or any other suitable items can be attached by the magnets as is known in the art, and depending on the wants and/or needs of a user and the theater show that is to be performed. In one embodiment, the trim pieces are attached to holes in the top of the base component.

In use, the base components would come pre-assembled and ready for the user to configure them in any manner that they see fit, depending on the theater show to be performed. Thus, users can quickly create unique theater sets for theater shows without having to constantly build and tear down current sets. Accordingly, the modular theater flat device saves considerable time and space when creating theater sets by offering a reusable and modular device that can be tailored to specific needs and preferences.

In yet another embodiment, the modular theater flat device comprises a plurality of indicia.

In yet another embodiment, a method of creating different configurations for modular theater flats is disclosed. The method includes the steps of providing a modular theater flat device comprising a base component that compromises wood panels with an aluminum frame, with magnetic strips and screws positioned on the sides. The method also comprises securing multiple base components together via the magnetic strips and screws. Further, the method comprises bracing the base components upright in position via the triangular bracing legs. The method also comprises securing base components together that comprise windows and/or doors. Finally, the method comprises securing trim and other designs via magnets on the base components.

Numerous benefits and advantages of this invention will become apparent to those skilled in the art to which it pertains, upon reading and understanding the following detailed specification.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE PRESENT INVENTION

Figure 1:
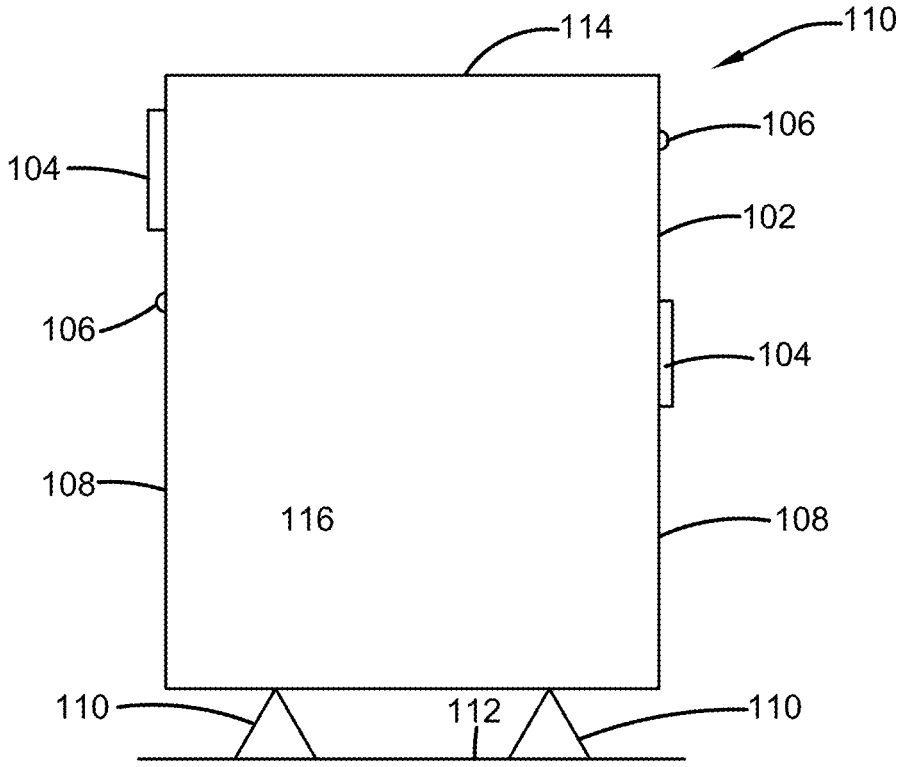
FIG. 1 illustrates a perspective view of one embodiment of the modular theater flat device of the present invention showing the base component of the device in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a long felt need in the art for a modular theater flat device that provides users with a device designed to be arranged in various configurations to create theater settings. There is also a long felt need in the art for a modular theater flat device that includes several aluminum and wood panels held together by magnetic strips and screws that can be arranged in a desired manner. Further, there is a long felt need in the art for a modular theater flat device that allows users to quickly create unique sets for theater shows without having to constantly build and tear down current sets. Moreover, there is a long felt need in the art for a device that saves considerable time and space when creating theater sets by offering a reusable device that can be tailored to specific needs and preferences. Further, there is a long felt need in the art for a modular theater flat device that comprises triangular bracing legs that help secure the device to the floor. Finally, there is a long felt need in the art for a modular theater flat device that contains magnets to hold on trim pieces.

The present invention, in one exemplary embodiment, is a novel modular theater flat device. The device is designed to allow the user to take theater flats apart and reconfigure them. The modular theater flat device comprises a base component that is configured in a rectangular shape that comprise wood panels with an aluminum frame, with magnetic strips and screws positioned on the sides. Multiple base components would then be secured together via the magnetic strips and screws. The frame can also have bolt holes to properly secure them together for use. Each base component also comprises triangular bracing legs that secure the base component to the floor. Further, at the top and bottom of each base component on a back surface there are positioned magnets to attach trim pieces to the front surface. Additionally, the base components can have doors and/or windows cut into them, as needed. The present invention also includes a novel method of creating different configurations for modular theater flats. The method includes the steps of providing a modular theater flat device comprising a base component that compromises wood panels with an aluminum frame, with magnetic strips and screws positioned on the sides. The method also comprises securing multiple base components together via the magnetic strips and screws. Further, the method comprises bracing the base components upright in position via the triangular bracing legs. The method also comprises securing base components together that comprise windows and/or doors. Finally, the method comprises securing trim and other designs via magnets on the base components.

Referring initially to the drawings, FIG. 1 illustrates a perspective view of one embodiment of the modular theater flat device 100 of the present invention. In the present embodiment, the modular theater flat device 100 is an improved modular theater flat device 100 that provides a user with a device that can be arranged in various configurations to create theater settings. Specifically, the modular theater flat device 100 comprises a base component 102, with magnetic strips 104 and screws 106 positioned on the sides 108. Multiple base components 102 would then be secured together via the magnetic strips 104 and screws 106. The base components 102 would come pre-assembled and ready for the user to configure them in the manner that they see fit. Each base component 102 also comprises triangular bracing legs 110 that secure the base component 102 to the floor 112, during use.

Typically, a theater flat is a lightweight timber frame covered with scenic canvas, or plywood. Flats are used to provide a lightweight and easy to move and re-configure backdrop to a stage set. Flats sometimes have windows or doors built into them to provide extra flexibility, for use in realistic settings.

Generally, the modular theater flat device 100 comprises a base component 102 that is configured in a rectangular shape but can be any suitable shape as is known in the art, depending on the needs and/or wants of a user, such as square, circular, etc. Typically, the base component 102 can be any suitable size and shape as is known in the art, depending on the theater set that needs to be built for the respective theater show.

Further, the base component 102 is comprised of a frame 114 and center panel 116 of varying sizes and shapes, that are manufactured of wood panels and aluminum, but can be manufactured of any suitable material as is known in the art. For example, the frame 114 can comprise aluminum, carbon fiber, steel, wood, composite materials, etc., or any other suitable materials as is known in the art. Further, the center panel 116 can then be manufactured of wood panels or composite materials, such as carbon fiber sheets, plastic particle board, wood particle board, etc., or any other suitable materials as is known in the art.

Figure 2:
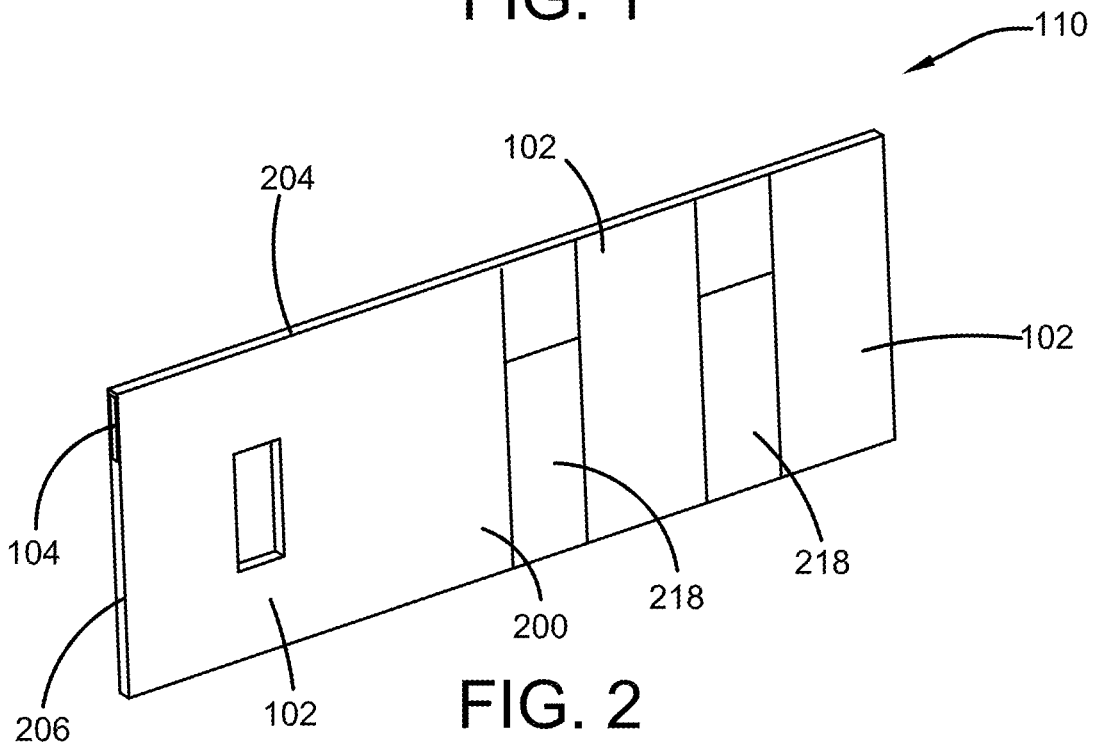
FIG. 2 illustrates a perspective view of one embodiment of the modular theater flat device of the present invention showing the base components secured together in accordance with the disclosed architecture.

As shown in FIG. 2, the center panel 116 of the base component 102 comprises a front surface 200 and a rear surface 202, with the top and bottom opposing edges 204 and the right and left opposing edges 206 being attached to the frame 114. Further, the frame 114 comprises a front surface 208, a rear surface 210, a side 212 which contacts the center panel 116 and a side 214 which faces away from the center panel 116. The frame 114 would be secured to the center panel 116 via any suitable securing means as is known in the art, such as glue, screws, bolts, etc., with the side 212 that contacts the center panel 116. Further, the side 214 of the frame 114 which faces away from the center panel 116 would comprise magnetic strips 104 and screws 106. Accordingly, the vertical side 214 of the frame 114 would comprise a plurality of magnets 104 which connect the base component 102 with another base component 102. Thus, multiple base components 102 can then be secured together side-by-side via the magnetic strips 104 and screws 106.

Further, the frame 114 can also comprise bolt holes 216 to properly secure the base components 102 together for use. In this embodiment, the magnets 104 are there to help with the alignment between the base components 102. Once the magnets 104 help align the base components 102 in proper positioning, the bolt holes 216 allow insertion of bolts to secure the base components 102 together during use, to prevent the base components 102 from being inadvertently pulled apart.

Additionally, the base components 102 can be manufactured in different configurations, depending on the needs and/or wants of a user. For example, a base component 102 can have a door 218 cut out positioned on it. Further, the base component 102 can have a window 220 cut out positioned on it. Finally, the base component 102 can have a door 218 and/or a window 220 cut out positioned on it. The windows 220 and doors 218 can be any suitable size, style, and shape as is known in the art. Further, these base components 102 with door 218 and/or window 220 cut outs would also have magnets 104 and bolt holes 216, such that the doors 218 and windows 220 are easy to align and can easily be put in or taken out and replaced by a new design or different type of door 218 or window 220. In one embodiment, the base components 102 comprise a removable face 221 to make it easier to change the background scenery, typically using a keyhole design. In another embodiment, the base components 102 can comprise corner components 225 to change the angles that the base components 102 are positioned in.

Figure 3:
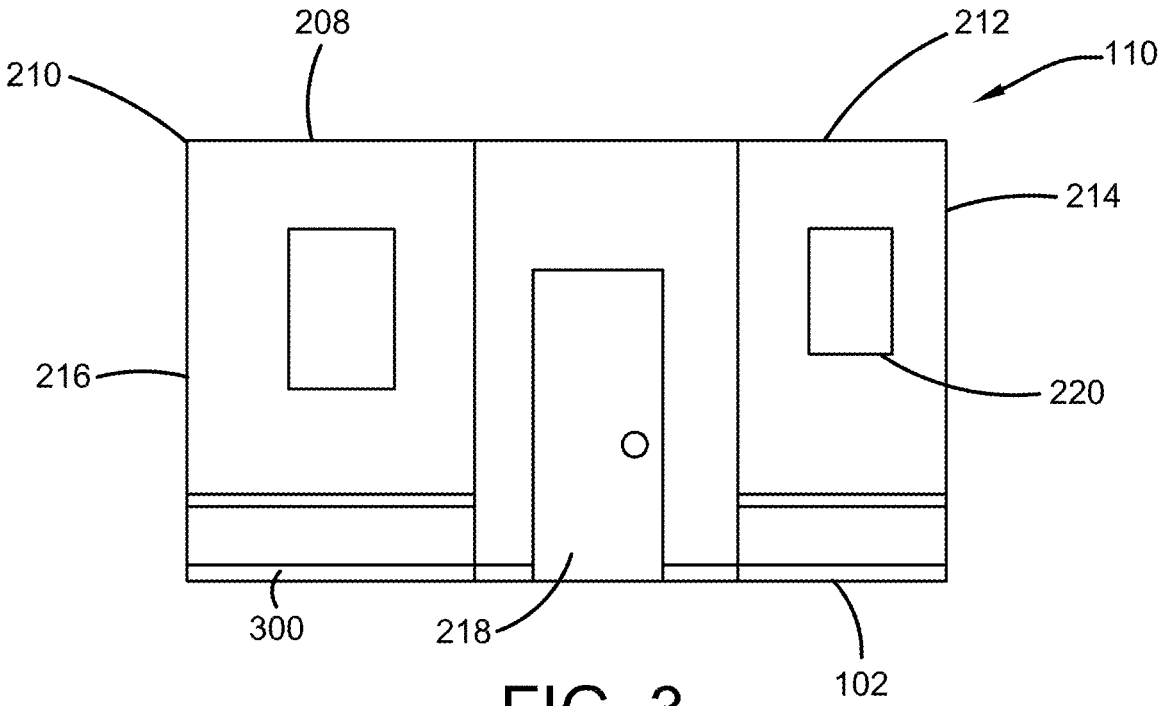
FIG. 3 illustrates a perspective view of one embodiment of the modular theater flat device of the present invention showing base components with magnetic trim in accordance with the disclosed architecture.
Figure 4:
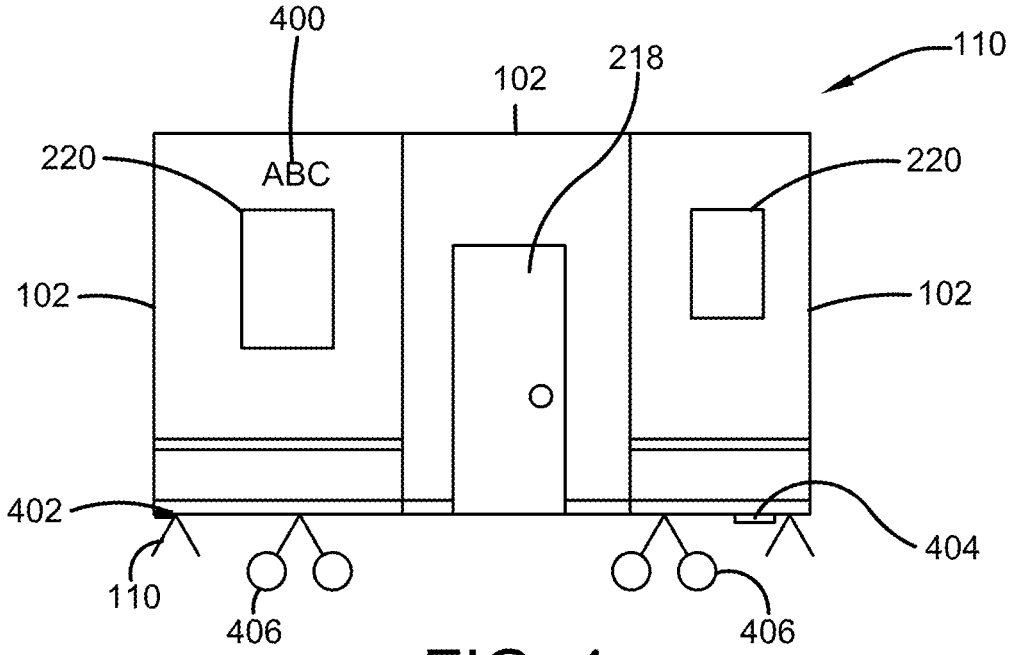
FIG. 4 illustrates a perspective view of one embodiment of the modular theater flat device of the present invention showing the base components with triangular bracing legs in accordance with the disclosed architecture.

As shown in FIG. 3, the base component 102 can comprise a plurality of magnets 104 secured to the back side 202, 210. The magnets 104 are used to releasably secure trim pieces 300 to the front side 200, 208 of the base components 102. Specifically, the trim 300 is typically secured to the top and bottom 204 of each base component 102 and/or around the cut-out doors 218 and windows 220. However, the trim 300 can be magnetically secured to any suitable front surface 200, 208 of the base component 102, depending on the wants and/or needs of a user. Further, the magnets 104 can also secure artwork, designs, patterns, photos, etc., or any other suitable items can be attached by the magnets 104 as is known in the art, and depending on the wants and/or needs of a user and the theater show that is to be performed. In one embodiment, the trim pieces 300 are attached to holes 407 in the top of the base component 102.

As shown in FIGS. 4 and 6A-D, the base component 102 comprises a pair of triangular bracing legs 110 that secure the base component 102 to the floor 112. Typically, the back 202, 210 of each base component 102 comprises hinges 402 which secure to the triangular bracing legs 110. The hinges 402 allow the legs 110 to swing out to support the base components 102, during use. Thus, the legs 110 can be extended out for use or retracted up toward the base component 102 when needing to be stored. Once extended to prop up the base components 102, the legs 110 can be bolted to the floor 112 and/or weights 404 can be positioned on them, so the base components 102 don't move and are held securely in place via the legs 110. Any suitable number of legs 110 can be utilized as is known in the art, typically there are two legs 110 on each base component 102. In one embodiment, the base component 102 also comprises a pair of long legs 403 with attachment points 405 on the back of the base component 102 that help to stabilize the base component 102.

Further, the base component 102 can also comprise a set of locking castors 406 or wheels, which allow the base component 102 to be easily moved on stage and transported to different rooms, theaters, etc. Any suitable number of castors 406 can be utilized as is known in the art, typically there are two castors 406 on each base component 102. Further, the castors 406 would typically lock, so that once the base component 102 is in position, the castors 406 won't be able to be moved and the base component 102 can be held in place. In one embodiment, the castors 406 can be secured to hinges 402, which like the legs 110, can be extended out for use or retracted up toward the base component 102 when needing to be stored. In one embodiment, castor wheels 406 can be secured to the pair of triangular bracing legs 110, which can be put on through the bolt holes 407 on the edges of the base component 102.

In use, the base components 102 would come pre-assembled and ready for the user to configure them in any manner that they see fit, depending on the theater show to be performed. Thus, users can quickly create unique theater sets for theater shows without having to constantly build and tear down current sets. Accordingly, the modular theater flat device 100 saves considerable time and space when creating theater sets by offering a reusable and modular device 100 that can be tailored to specific needs and preferences.

In yet another embodiment, the modular theater flat device 100 comprises a plurality of indicia 400. The base component 102 of the device 100 may include advertising, a trademark, or other letters, designs, or characters, printed, painted, stamped, or integrated into the base component 102, or any other indicia 400 as is known in the art. Specifically, any suitable indicia 400 as is known in the art can be included, such as but not limited to, patterns, logos, emblems, images, symbols, designs, letters, words, characters, animals, advertisements, brands, etc., that may or may not be theater, flats, sets, or brand related.

Figure 5:
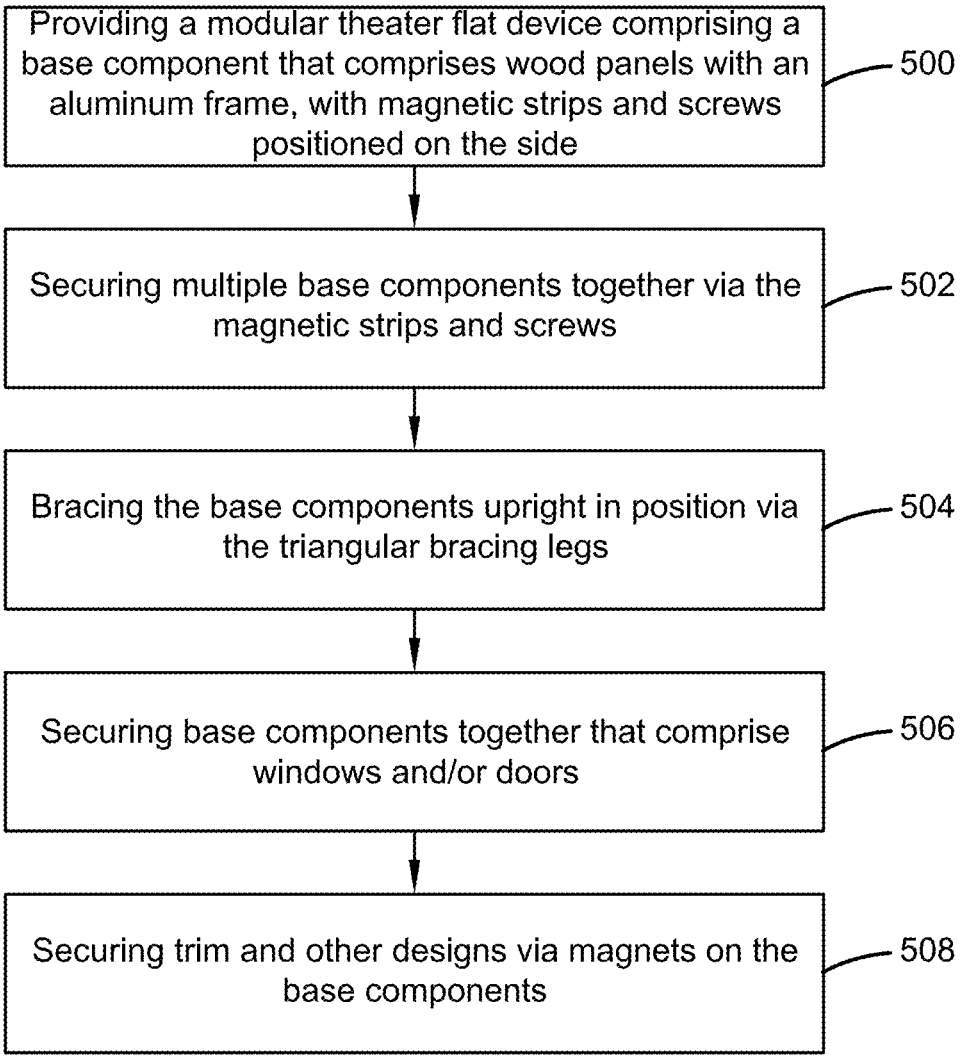
FIG. 5 illustrates a flowchart showing the method of creating different configurations for modular theater flats in accordance with the disclosed architecture.
Figure 6A:
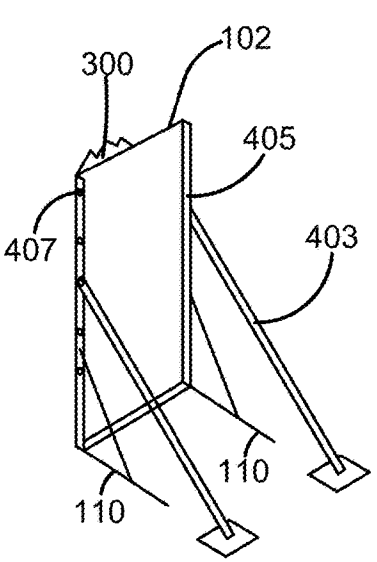
FIGS. 6A-D illustrate a perspective view of one embodiment of the modular theater flat device of the present invention showing the bracing legs and wheels in accordance with the disclosed architecture.
Figure 6B:
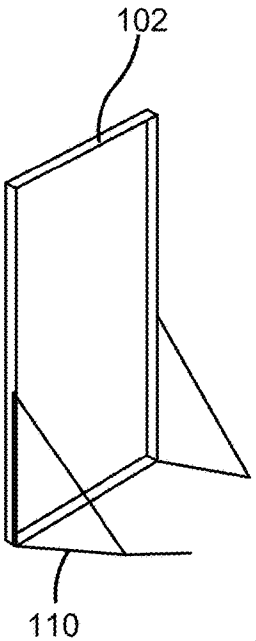
Figure 6C:
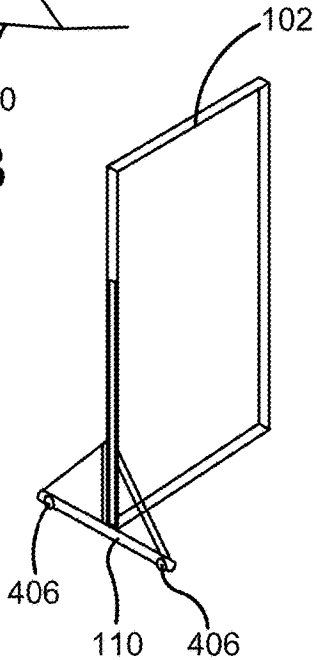
Figure 6D:
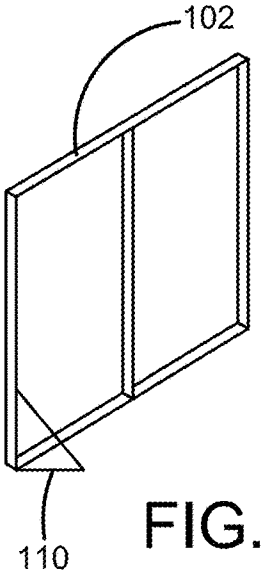

FIG. 5 illustrates a flowchart of the method of creating different configurations for modular theater flats. The method includes the steps of at 500, providing a modular theater flat device comprising a base component that compromises wood panels with an aluminum frame, with magnetic strips and screws positioned on the sides. The method also comprises at 502, securing multiple base components together via the magnetic strips and screws. Further, the method comprises at 504, bracing the base components upright in position via the triangular bracing legs. The method also comprises at 506, securing base components together that comprise windows and/or doors. Finally, the method comprises at 508, securing trim and other designs via magnets on the base components.

Certain terms are used throughout the following description and claims to refer to particular features or components.

As one skilled in the art will appreciate, different users may refer to the same feature or component by different names. This document does not intend to distinguish between components or features that differ in name but not structure or function. As used herein "modular theater flat device", "modular device", "theater flat device", and "device" are interchangeable and refer to the modular theater flat device 100 of the present invention.

Notwithstanding the forgoing, the modular theater flat device 100 of the present invention can be of any suitable size and configuration as is known in the art without affecting the overall concept of the invention, provided that it accomplishes the above stated objectives. One of ordinary skill in the art will appreciate that the modular theater flat device 100 as shown in FIGS. 1-6 is for illustrative purposes only, and that many other sizes and shapes of the modular theater flat device 100 are well within the scope of the present disclosure. Although the dimensions of the modular theater flat device 100 are important design parameters for user convenience, the modular theater flat device 100 may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A modular theater flat device that can be arranged in various configurations to create theater settings, the modular theater flat device comprising:

a base component configured in a rectangular shape and comprising a frame and a center panel;

wherein vertical sides of the base component comprise magnetic strips and screws, which act to connect the base component with a second base component to form a theater set;

wherein the frame comprises bolt holes to properly secure the base component and the second base component together for use;

wherein the base component includes a window or a door cut out;

wherein the second base component includes both a window and a door cut out;

wherein the base component and the second base component comprises a plurality of magnets secured to a back side to releasably secure trim pieces to a front side of the base component and the second base component;

wherein the base component and the second base component comprises a pair of triangular bracing legs and a set of long legs that secure to the base component and the second base component via a set of hinges, which allow the triangular bracing legs to be extended out for use or retracted up toward the base component and the second base component when needing to be stored; and further wherein the pair of triangular bracing legs comprises a set of castors, which allow for easy transportation.

2. The modular theater flat device of claim 1, wherein once extended to prop up the base component and the second base component, the triangular bracing legs are bolted to a floor or weights are positioned on them, so the base component and the second base component are held securely in place.

3. The modular theater flat device of claim 1, wherein the set of castors are locking castors which can be locked, once the base component and the second base component are in position.

4. The modular theater flat device of claim 1, wherein the magnets secure artwork, designs, patterns, and photos.

5. The modular theater flat device of claim 1 further comprising corner components to change angles that the base components are positioned in.

* * * * *